United States Patent [19]

Hirukawa et al.

[11] Patent Number: 4,909,764

[45] Date of Patent: Mar. 20, 1990

[54] IGNITION TIMING CONTROL SYSTEM FOR MARINE PROPULSION UNIT

[75] Inventors: Itsushi Hirukawa; Kazuya Takeuchi, both of Hamamatsu, Japan

[73] Assignee: Sanshin Kogyo Kabushiki Kaisha, Hamamatsu, Japan

[21] Appl. No.: 252,042

[22] Filed: Sep. 30, 1988

[30] Foreign Application Priority Data

Oct. 2, 1987 [JP] Japan ..... 62-248100

[51] Int. Cl.[4] ..... B63H 21/26

[52] U.S. Cl. ..... 440/1; 123/406; 123/417; 123/418

[58] Field of Search ..... 440/1, 61, 900, 87; 123/406, 415–418

[56] References Cited

U.S. PATENT DOCUMENTS

| | | | |
|---|---|---|---|
| 3,913,517 | 10/1975 | Lohse et al. | 440/61 |
| 3,935,845 | 2/1976 | Aono et al. | 123/422 |
| 4,582,032 | 4/1986 | Hara et al. | 123/339 |
| 4,803,967 | 2/1989 | Ohkumo | 123/418 X |

*Primary Examiner*—Sherman D. Basinger

*Attorney, Agent, or Firm*—Ernest A. Beutler

[57] ABSTRACT

A marine outboard drive incorporating a power operated tilt and trim arrangement and an arrangement for increasing the speed of the engine when the power operated tilt and trim device is operated so as to avoid speed changes during tilt and trim operation. The speed increasing is achieved by altering the spark advance curve and is only done when the propulsion device is driving the watercraft and when the engine generator is generating a predetermined power output.

29 Claims, 3 Drawing Sheets

IGNITION TIMING CONTROL SYSTEM FOR MARINE PROPULSION UNIT

BACKGROUND OF THE INVENTION

This invention relates to an ignition timing control system for a marine propulsion unit and more particularly to an improved arrangement for controlling the engine operation in a marine propulsion unit.

As is well known, marine propulsion units normally include an outboard drive portion that is supported for trim adjustment on the transom of the associate watercraft so as to vary the trim angle of the propulsion device carried by the outboard drive. The propulsion device is driven by an internal combustion engine which may be mounted internally of the hull in applications employing inboard/outboard drives or which may be mounted directly upon the outboard drive in the case of outboard motors. With larger units of this type, it is frequently the practice to employ some form of powering device for achieving trim adjustment during running conditions. Frequently, the power device is comprised of an electric motor driven reversible pump that operates a hydraulic motor for achieving the trim adjustment. In some instances, the electric motor itself may also serve as the powering device through a mechanical connection between the electric motor and the outboard drive.

Regardless of whether an electrical, hydraulic or purely electrical power trim adjustment is employed, when the trim is operated, this places an additional load on the engine which can reduce its running speed. The simultaneous trim adjustment and reduction of engine speed and, accordingly, the speed of driving of the propulsion unit can deteriorate the handling and navigational capabilities of the watercraft for brief instances.

It is, therefore, an object of this invention to provide an arrangement for insuring that the speed of the powering engine will not be reduced when the power trim unit of a marine outboard drive is actuated.

It is a further object of this invention to provide an arrangement for insuring continuous running speed of the engine during power trim adjustment.

In many cases, such as marine outboard drive applications as previously described, the internal combustion engine in addition to powering a propulsion device, also powers other auxiliary components. When these components are caused to be operated, the added load on the engine can reduce its speed. Although arrangements have been incorporated for preventing such speed reductions, they tend to increase the speed of the engine under all conditions when the additional load is driven and regardless of whether engine speed increases are required.

It is, therefore, a still further object of this invention to provide an arrangement for controlling the speed of an engine which drives both a propulsion device and a load but which will effect only speed increases of the engine when the load is operated and the engine otherwise requires the speed increase.

SUMMARY OF THE INVENTION

A first feature of this invention is adapted to be embodied in a marine outboard drive that is comprised of an outboard drive containing a propulsion device and which is adapted to be mounted on the hull of a watercraft for movement between selected trim adjustment positions. An internal combustion engine is incorporated for driving the propulsion device. Power means are also provided for operating the outboard drive to adjust the trim condition thereof and the power means is operated by power derived from the internal combustion engine. In accordance with this feature of the invention, means are incorporated for increasing the speed of the engine in response to the operation of the power means.

Another feature of this invention is adapted to be embodied in a control for an internal combustion engine that drives a first load through a transmission having at least a forward and a neutral condition. A second load is driven selectively by the engine and engine speed increasing means are incorporated for automatically increasing engine speed. In accordance with this feature of the invention, means are provided for effecting operation of the engine speed increasing means when the second load is driven and when the transmission is not in the neutral condition.

DETAILED DESCRIPTION OF THE PREFERRED EMBODIMENT

Figure 1:
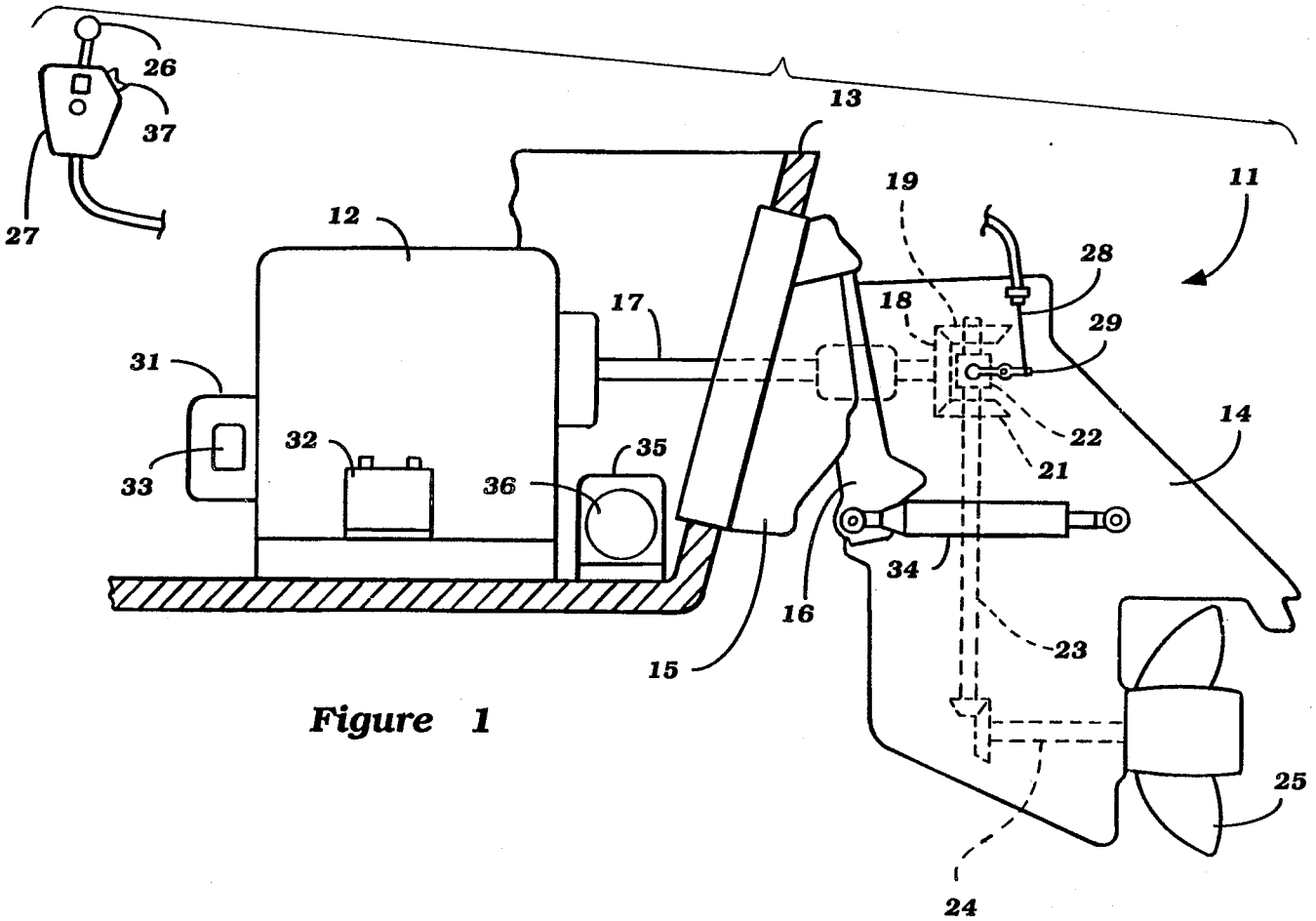
FIG. 1 is a partial side elevational view, with portions shown in section, of a marine outboard drive constructed in accordance with an embodiment of the invention.

Referring first to FIG. 1, a marine outboard drive constructed in accordance with an embodiment of the invention is identified generally by the reference numeral 11. The marine outboard drive is, in the illustrated embodiment, of the inboard/outboard type including an inboard mounted internal combustion engine 12 that is contained within the hull 13 of the watercraft and an outboard drive unit 14 that is mounted on the transom of the hull for both steering and tilting operation. This mounting arrangement includes a transom bracket 15 that is mounted to the hull 13 and which supports a gimbal ring 16 for steering movement about a steering axis. The outboard drive 14 is supported for tilting movement relative to the gimbal ring 16 in a known manner.

The engine 12 may be of any known type and is, in the illustrated embodiment, of the spark ignited type although it is to be understood that certain aspects of the invention may be applied to engines other than spark ignited engines. However, the invention has particular utility when applied to spark ignited engines inasmuch as the speed of the engine may be controlled by controlling the spark advance angle, as will become apparent. Also, in the illustrated embodiment, the engine 12 may be either of the two stroke or four stroke type and may be either a reciprocating or rotating engine.

The engine 12 drives an output shaft 17 that extends through the transom of the hull 13 and which drives an input bevel gear 18 that is in mesh with a pair of counterrotating bevel gears 19 and 21 of a forward, neutral, reverse transmission that is contained within the outboard drive 14. A dog clutching mechanism including a dog clutching sleeve 22 is adapted to selectively couple either of the gears 19 or 21 for rotation with a vertically extending drive shaft 23 that is journaled within the outboard drive 14. The drive shaft 23 drives a propeller shaft 24 to which a propeller 25 is affixed in a known manner.

In order to effect shifting of the bevel gear transmission comprised of the gears 18, 19 and 21, there is provided a remotely positioned shift control lever 26 carried by a control support 27 that is positioned in proximity to the operator's seat of the watercraft. The shift control lever 26 operates a bowden wire cable 28 which, in turn, pivots a bellcrank 29 so as to achieve shifting of the dog clutching element 22 to selectively drive the propeller 25 in forward, neutral or reverse conditions, as is well known in this art.

The engine 12 drives a generator 31 which may be of any known type so as to charge a storage battery 32 and provide electrical power for the ignition system of the engine 12 and other electrically operated components of the watercraft. A voltage regulator 33 is carried by the generator 32 and provides an output signal indicative of the generation of power by the generator 31.

In order to achieve trim control and tilting up of the outboard drive 14, there is provided a pair of fluid motors 34 that are connected between the gimbal ring 16 and the outboard drive 14. The fluid motors 34 are operated by means of a hydraulic system 35 of any known type which is powered by a reversible electric motor 36. The motor 36 is controlled by means of a tilt and trim control switch 37 that is mounted on the control handle member 27 so as to permit operator selection of the tilt and trim position of the outboard drive. If desired, this system may also be utilized in conjunction with any of the known systems wherein automatic trim adjustment is incorporated in addition to the manual control.

It should be understood that the construction of the outboard drive as thus far described may be considered to be conventional. Also, as has been previously noted, the invention may be employed in conjunction with outboard motors per se and other forms of power tilt and trim mechanisms than electrical hydraulic systems.

Figure 2:
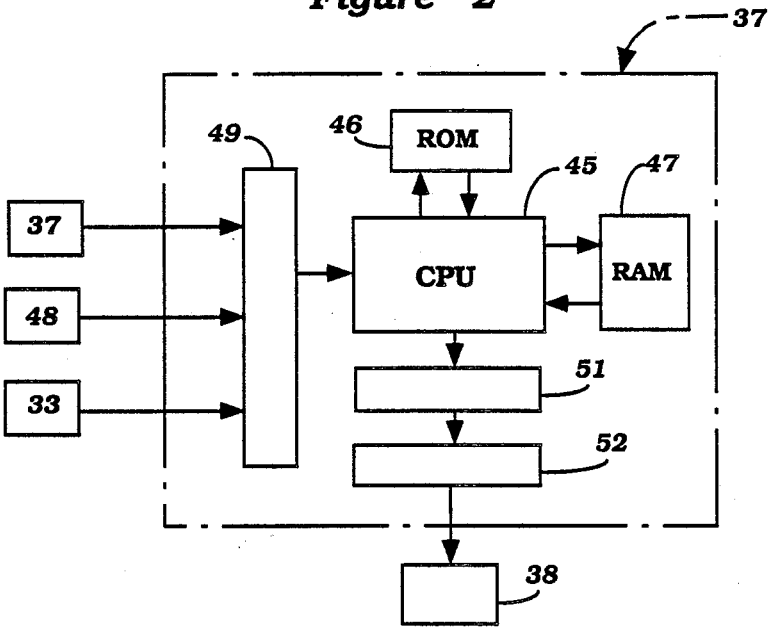
FIG. 2 is a schematic view showing the electronic control of the speed increasing means.

Referring now to FIG. 2, there is incorporated and disclosed a control system, indicated generally by the reference numeral 37 that is designed to control the speed of the outboard motor 12 in response to certain characteristics, as aforedescribed. This system 37 operates on the ignition system and specifically the spark advance mechanism 38 of the associated internal combustion engine.

Figure 3:
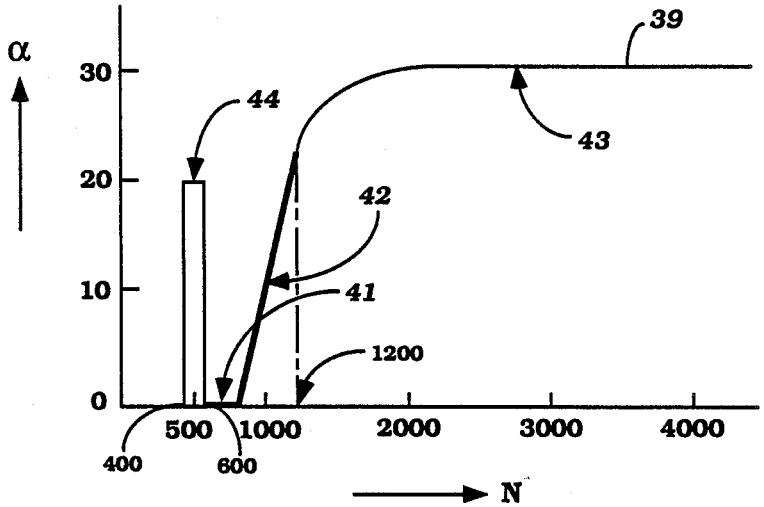
Figure 3 Prior Art
FIG. 3 is a spark advance timing curve of an engine constructed in accordance with the prior art.

FIG. 3 shows a conventional spark advance curve for an internal combustion engine. In this figure, spark advance $\alpha$ is shown on the ordinate and engine speed N is shown on the abscissa. The spark advance curve $\alpha$ indicates the time at which the spark plug of the engine fires before top dead center of the piston: It should be understood that the depicted spark advance curve is of a typical type although the actual configuration may vary from engine to engine and on different applications. Basically, the spark advance curve, indicated by the solid line 39 is comprised of a first portion 41 from normal engine idle speed at 600 rpm up to a relatively low off idle speed which is constant at a fixed advance. From this point to a predetermined low speed range, such as 1200 rpm, the spark is advanced along a fixed advance curve line 42. At about 1200 rpm, the spark advance is gradually tapered off and then is held at a fixed advance curve 43 throughout the remainder of the engine speed and load ranges.

The ignition system 38 may also incorporate an arrangement for achieving a fixed spark advance 44 under certain low speed conditions, such as between cranking speed and idle speed so as to prevent stalling of the engine under certain emergency or other conditions. Such an arrangement is disclosed in copending application Ser. No. 247,748, filing date Sept. 21, 1988, entitled "Spark Timing Controller For Spark Ignited Internal Combustion Engine", filed in the name of Itsushi Hirukawa, and assigned to the assignee of this application.

Referring now again to FIG. 2, the engine speed control system 37 includes a CPU 45 that cooperates with a ROM 46 and RAM 47 to provide a control system which will be described in conjunction with FIG. 4. The CPU 45 also receives input signals from the tilt control switch 37, the generator voltage regulator 33 and a shift switch 48 that indicates if the transmission is in neutral or not through an input interface 49. The CPU 45 processes these signals in accordance with the program stored in the ROM 46 and RAM 47 and outputs a control signal through an output interface 51 to a spark or speed control servo 52 that controls the spark mechanism 38 so as to achieve advancing in accordance with a curve as shown in FIG. 5.

Figure 5:
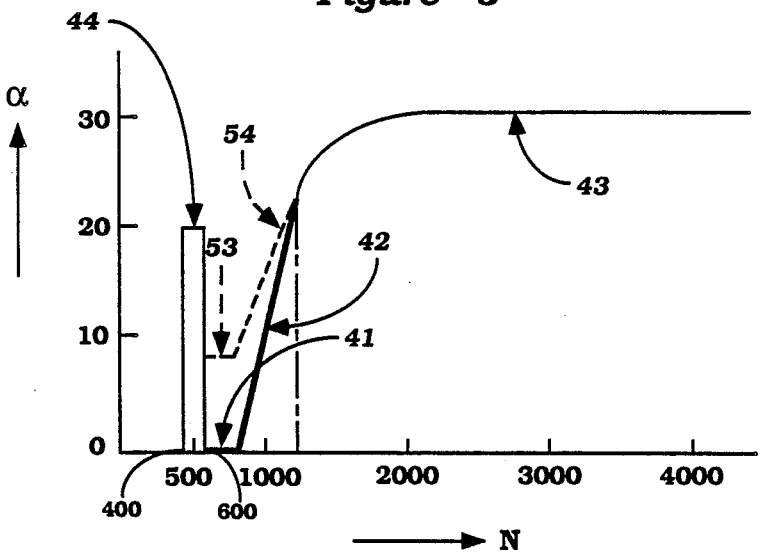
FIG. 5 is a spark timing curve, in part similar to FIG. 3, showing the spark timing characteristics in accordance with the invention.

As may be seen in FIG. 5, the system in accordance with this invention includes the general spark advance characteristics of the conventional prior art system as shown in FIG. 3 and these spark control curves are indicated by the same reference characters 41, 42, 43 and 44. In addition to this spark control curve, however, the system also includes an automatic spark advance mechanism which at engine speeds between idle and approximately 750 rpm provides a fixed spark advance 53 that is greater than the normal spark advance curve and will, accordingly, effect a speed increase. From this speed (750 rpm) up until 1200 rpm, the spark advance curve 54 is followed which provides a gradually increasing spark advance above the normal spark advance curve 42 at these speeds. The curve 54 then matches the curve 43 and normal spark advance is accomplished at increased speeds.

Figure 4:
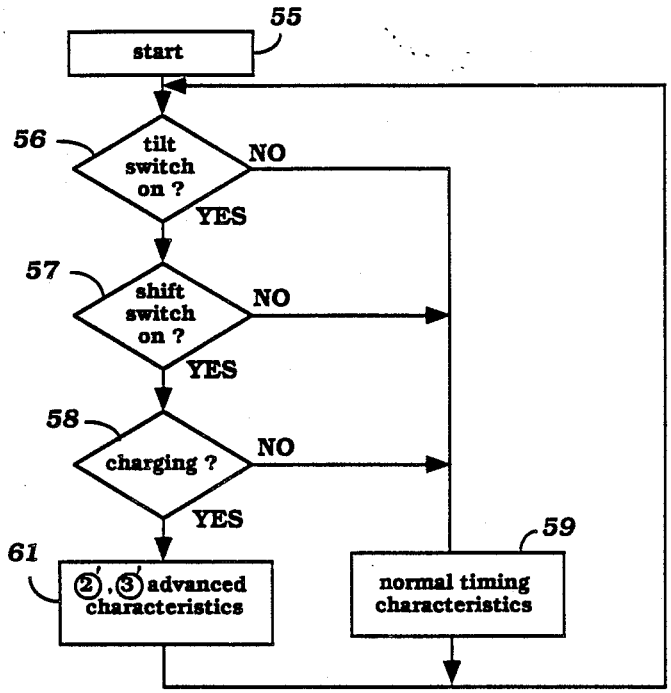
FIG. 4 is a schematic block diagram showing the logic of the speed control constructed in accordance with the illustrated embodiment of the invention.

The routine of operation of the system may be seen in FIG. 4. Basically, the logic of the system is that speed increasing is accomplished only in the event the tilt switch 37 is activated, the shift switch 48 indicates that the transmission is not in neutral and hence the propulsion unit (propeller 25) is being driven and also that the battery is charging inasmuch as the voltage regulator 33 indicates an output. In all three of these instances, the spark will be advanced to follow the curve 53, 54 and 43 rather than the normal curve 41, 42 and 43 so as to provide speed increase. This will insure that the operation of the tilt and trim unit including the electric motor 36 will not cause a decrease in speed of the propeller 25 so as to adversely affect handling. This speed increase is not required, however, when the transmission is in neutral nor is it required when the charging generator 31 is not generating a charge because this will indicate some other trouble or fault and thus the start of the tilting motor does not relate to the cause of engine speed reduction.

Referring now specifically to FIG. 4, the routine is started at the step 55. The program then moves through the steps 56, 57 and 58 in sequence to determine if first the tilt switch 37 is on, then whether the shift switch 48 indicates that the transmission is not in neutral and, finally, if the generator as indicated by the voltage regulator 33 is outputting a signal. In the event the tilt switch is not on, the program moves to the step 59 so as to follow the normal spark timing curve 41, 42 and 43. In a like manner, even if the tilt switch is on and the shift switch 48 indicates that the transmission is in neutral, the program moves to the step 59 to maintain normal spark advance, for the reasons aforenoted. In a like manner, if both the tilt switch and shift switch are on, the normal timing characteristics will still be followed if the generator 31 is not normally charging. However, if all of the conditions 56, 57 and 58 are met, the program moves to the step 61 to follow the speed increasing timing curve 53, 54.

It should be readily apparent from the foregoing description that an extremely effective system is provided so as to insure that the tilt and trim operation of a marine outboard drive will not result in an engine speed decrease. Also, it is insured that the engine speed will not be increased under circumstances when it is not required. It is also to be understood that the foregoing description is that of a preferred embodiment of the invention and that various changes and modifications may be made without departing from the departing from the spirit and scope of the invention, as defined by the appended claims.

We claim:

1. In a marine outboard drive comprised of an outboard drive comprising a propulsion device adapted to be mounted on the hull of a watercraft for movement between selected trim adjusted positions, an internal combustion engine for driving said propulsion device, power means for operating said outboard drive for adjusting the trim condition thereof, said power means being operated by power derived from said internal combustion engine, the improvement comprising means for increasing the speed of said engine in response to the operation of said power means.

2. In a marine outboard drive as set forth in claim 1 wherein the engine is of the spark ignited type and the speed of the engine is increased by altering the spark advance.

3. In a marine outboard drive as set forth in claim 2 wherein the spark advance is only altered when the engine speed is below a predetermined engine speed.

4. In a marine outboard drive as set forth in claim 1 wherein the power means includes an electric motor driven by electrical power generated by the internal combustion engine.

5. In a marine outboard drive as set forth in claim 4 wherein the electric motor achieves trim adjustment by powering a fluid pump and fluid motor.

6. In a marine outboard drive as set forth in claim 5 wherein the engine is of the spark ignited type and the speed of the engine is increased by altering the spark advance.

7. In a marine outboard drive as set forth in claim 6 wherein the spark advance is only altered when the engine speed is below a predetermined engine speed.

8. In a marine outboard drive as set forth in claim 1 further including forward, neutral transmission means for driving the propulsion device from the internal combustion engine and wherein the means for increasing the speed of the engine only increases the speed of the engine when the power means is operated and the transmission is not in neutral.

9. In a marine outboard drive as set forth in claim 8 wherein the engine is of the spark ignited type and the speed of the engine is increased by altering the spark advance.

10. In a marine outboard drive as set forth in claim 9 wherein the spark advance is only altered when the engine speed is below a predetermined engine speed.

11. In a marine outboard drive as set forth in claim 8 wherein the power means includes an electric motor driven by electrical power generated by the internal combustion engine.

12. In a marine outboard drive as set forth in claim 11 further including an electric generator driven by the internal combustion engine and powering the electric motor and wherein the means for increasing the speed of the engine is only effective to increase the speed of the engine in the event that the transmission is not in neutral, the power means is operated and the generating means is generating more than a predetermined power.

13. In a marine outboard drive as set forth in claim 1 wherein the engine drives a generator and wherein the means for increasing the speed of the engine only increases the speed of the engine in the event the power means is operated and the generator is developing more than a predetermined amount of electrical power.

14. In a marine outboard drive as set forth in claim 13 wherein the engine is of the spark ignited type and the speed of the engine is increased by altering the spark advance.

15. In a marine outboard drive as set forth in claim 14 wherein the spark advance is only altered when the engine speed is below a predetermined engine speed.

16. In a marine outboard drive as set forth in claim 14 wherein the power means includes an electric motor driven by electrical power generated by the internal combustion engine.

17. In a marine outboard drive as set forth in claim 16 wherein the electric motor achieves trim adjustment by powering a fluid pump and fluid motor.

18. In a marine outboard drive as set forth in claim 1 wherein the speed of the engine is increased only in the event the speed of the engine is below a predetermined value.

19. In a control for an internal combustion engine driving a first load through a transmission having at least a forward and a neutral condition, a second load driven selectively by said engine, and engine speed increasing means for automatically increasing engine speed, the improvement comprising means for effecting operation of said engine speed increasing means only when said second load is driven and said transmission is not in the neutral condition.

20. In a control as set forth in claim 19 further including a generator driven by the engine and wherein the engine speed increasing means is not operated unless the generator is also generating more than a predetermined power.

21. In a control as set forth in claim 20 wherein the engine is of the spark ignited type and the speed of the engine is increased by altering the spark advance.

22. In a marine outboard drive as set forth in claim 21 wherein the spark advance is only altered when the engine speed is below a predetermined engine speed.

23. In a control as set forth in claim 21 wherein the spark advance is increased by following a different spark advance curve than the normal spark advance curve.

24. In a control as set forth in claim 23 in combination with a marine outboard drive wherein the first load comprises a propulsion device for a watercraft.

25. In a control as set forth in claim 19 wherein the engine is of the spark ignited type and the speed of the engine is increased by altering the spark advance.

26. In a marine outboard drive as set forth in claim 25 wherein the spark advance is only altered when the engine speed is below a predetermined engine speed.

27. In a control as set forth in claim 25 wherein the spark advance is increased by following a different spark advance curve than the normal spark advance curve.

28. In a control as set forth in claim 27 in combination with a marine outboard drive wherein the first load comprises a propulsion device for a watercraft.

29. In a marine outboard drive as set forth in claim 19 wherein the speed of the engine is increased only in the event the speed of the engine is below a predetermined value.

* * * * *